United States Patent [19]

Timari

[11] Patent Number: 4,662,098

[45] Date of Patent: May 5, 1987

[54] RELEASE MECHANISM FOR RIFLES

[76] Inventor: Jali Timari, SF-33100 Tampere, Tampere, Finland

[21] Appl. No.: 738,557

[22] Filed: May 28, 1985

[30] Foreign Application Priority Data

May 28, 1984 [FI] Finland ..... 842139

[51] Int. Cl.[4] ..... F41C 19/00

[52] U.S. Cl. ..... 42/69.01; 42/69.02

[58] Field of Search ..... 42/69 R, 69 A, 69 B, 42/70 R

[56] References Cited

U.S. PATENT DOCUMENTS

| | | | |
|---|---|---|---|
| 2,249,232 | 7/1941 | Smith | 42/69 A |
| 2,422,854 | 6/1947 | Reising | 42/69 A |
| 2,490,474 | 12/1949 | Roemer | 42/70 R |
| 3,707,796 | 1/1973 | Bielfeldt | 42/69 A |
| 3,863,375 | 2/1975 | Browning | 42/69 R |

FOREIGN PATENT DOCUMENTS

| | | | |
|---|---|---|---|
| 460553 | 6/1928 | Fed. Rep. of Germany | 42/69 A |

*Primary Examiner*—Deborah L. Kyle
*Assistant Examiner*—Ted L. Parr
*Attorney, Agent, or Firm*—Andrus, Sceales, Starke & Sawall

[57] ABSTRACT

The known detachable release mechanisms for rifles are not safe as the firearm might go off as the release mechanism is detached from a firearm that is in a cocked state. The release mechanism according to the invention includes a locking stud (8) placed within the frame (1) of the firearm which stud is movable with respect to the casing (3) of the release mechanism so that when the stud is in a locking position it will prevent the movement of the locking bar (4), as the casing is in a position locked to the frame. In addition, the cocking means include a release stem (6) pivoted within the casing and a cocking member (7) pivoted on the frame (1) which cocking member has been arranged to rest on the release stem as the casing is in a position locked to the frame.

7 Claims, 1 Drawing Figure

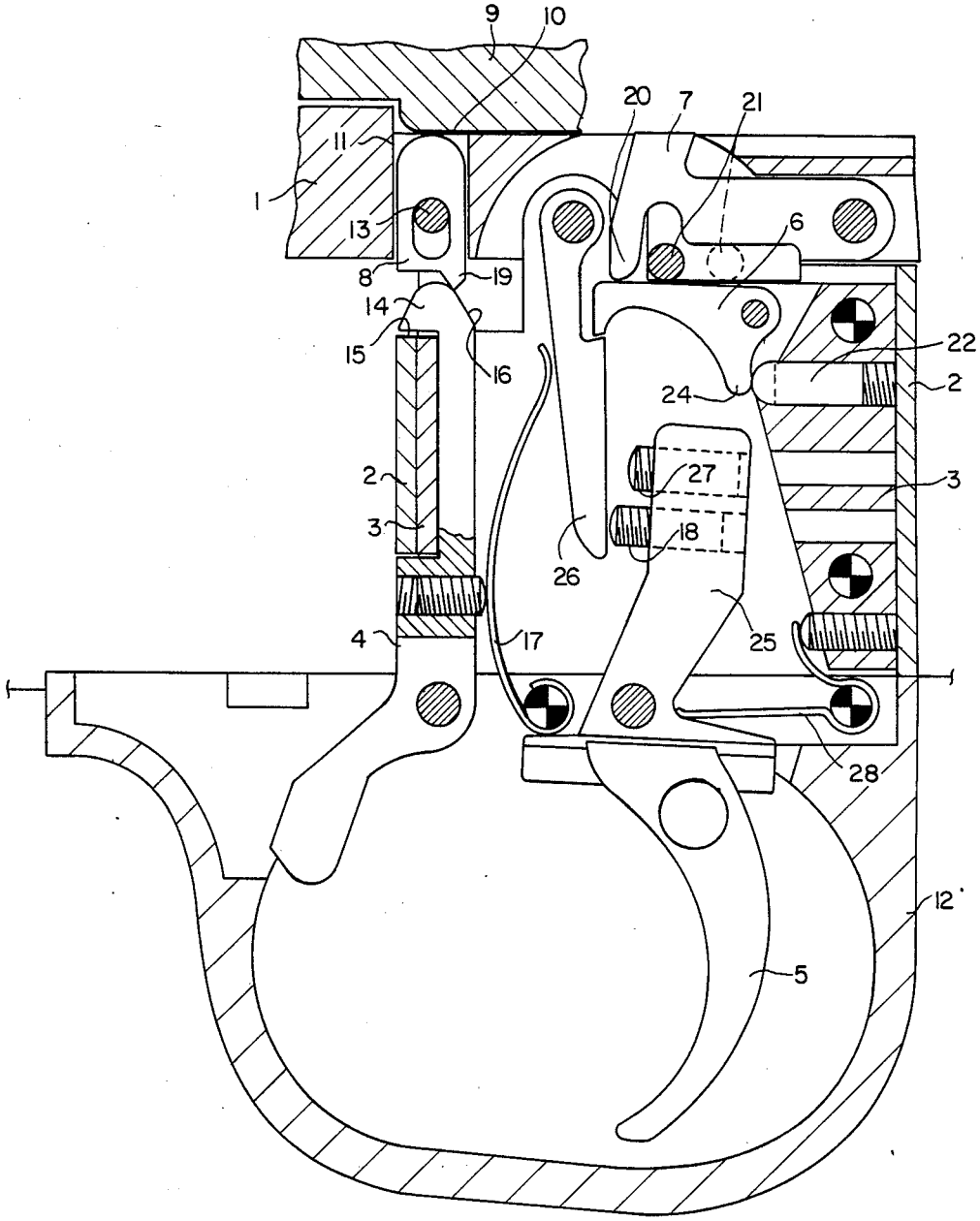
9
10
20
7
21
11
1
13
6
8
19
14
15
16
22
24
2
2
27
3
3
18
26
4
17
25
28
12
5

RELEASE MECHANISM FOR RIFLES

The object of the invention is a release mechanism for a rifle or a firearm or the like which includes a casing arranged to be attached in a detachable manner to the frame of the firearm, a locking bar for attaching the casing to the frame, a trigger and a release mechanism situated inside the casing which mechanism is arranged to transmit the movement of the trigger to the cocking means.

BACKGROUND OF THE INVENTION

It is known practice nowadays to equip a firearm with a detachable release mechanism which can be detached from the firearm for cleaning, adjusting, repairing or changing. The known mechanisms however include drawbacks which jeopardize safety. If the release mechanism can be detached from the firearm, while the firearm is in a cocked state, the firearm might go off, which presents a formidable danger. Moreover the usual safety means are complicated and subject to disturbances.

SUMMARY OF THE INVENTION

The object of the invention is to present an improvement in the detachable release mechanisms of a firearm. Especially an object of the invention is to bring about a release mechanism which can be easily detached from the firearm while the lock of the firearm is open, but which cannot be detached from the firearm while the lock is in a closed position. A further object is to bring about a release mechanism which is safe and easy to adjust and secure.

The objects of the invention are achieved by a release mechanism which is mainly characterized by the claims.

According to the invention the release mechanism includes a locking stud placed within the frame which stud is movable with respect to a frame and a casing. In it's locking position the stud is arranged to prevent the movement of a locking bar as the casing is in an attached position to the frame and that the locking means include a release stem pivotally mounted in the casing and a cocking member pivotally mounted on the frame which cocking member has been arranged to rest upon the release stem, when the casing is in an attached position to the frame and the firearm is in a cocked state. The locking stud prevents the removal of the release mechanism from the firearm as the locking stud is in it's locking position and similarly the cocking member can be secured so that the weapon won't go off, while the release mechanism is removed. A firearm equipped with this type of release mechanism is safe to use.

In an embodiment of the invention the lock of the firearm has been arranged to push the locking stud towards the locking bar, when the lock is in it's closed position. Thus, the locking stud locks the locking bar to it's position always, when the lock of the firearm is in a closed position so that the release mechanism can only detached from the firearm, when the lock is open. Therefore the firearm cannot go off, while detaching the release mechanism.

DESCRIPTION OF THE DRAWINGS

The invention is next explained in more detail by referring to the accompanying drawing which represents one embodiment of the release mechanism in accordance with the invention which mechanism in a position attached to the fire-arm. The drawing is a fragmentary longitudinal section.

DESCRIPTION OF THE PREFERRED EMBODIMENT p According to the embodiment presented in the drawing a front driven release mechanism for a firearm is shown which mechanism includes a casing 3, a locking bar 4, a trigger 5 with its trigger guard 12, cocking means 6,7 and a release device situated inside the casing for transmitting the trigger's movement to the cocking means 6,7. A downwards opening housing 2 has been formed in the frame 1 in which housing the casing 3 is detachably connected.

The casing 3 with its release device and trigger is pushed towards the opening formed by the housing. The locking bar 4 pivotally mounted to the casing 3 includes a locking shoulder 14 which surface facing the housing 2 is oblique so that the housing's edge impinges on said oblique surface as the casing 3 is pushed towards the housing. At the same time the locking bar turns with respect to its pivot and allows the insertion of the casing into the housing. As the casing is pushed towards the locking depth a spring 17 pushes the locking shoulder by the aid of a screw so that the shoulder engages behind edge (15) of the housing (2). Thus, the casing 3 is locked to the housing 2. The detachment takes place by turning the locking bar to the opposite direction and pulling the casing out of the housing.

The release mechanism includes a locking stud 8 which is mounted in a hole 11. As the stud is in its locked position it prevents the movement of the locking bar 4. The hole 11 has been arranged to extend from the locking chamber to the opening formed for the casing to a place near the edge 15. The locking stud has been arranged movably upon a support 13 within the hole.

The locking shoulder's surface 16 is arranged obliquely and a protrusion with a corresponding oblique surface 19 has been arranged on the end of locking stud 8 facing the casing 3. The lock 9 of the weapon is in it's locked position above the hole 11 so that the lower surface of the lock 9 presses the locking stud 8 towards the locking bar 4 so that the surface 19 of the locking stud engages on the surface 16 of the locking bar and prevents the movement of the locking shoulder 14 and the removal of the shoulder from the edge 15. This prevents the detachment of the casing from the fire-arm. When the lock 9 is in it's open position the locking stud 4 is free to move upwards as the locking bar is turned, thus, making it possible to detach the casing 3 from the weapon.

The cocking means include a release stem 6 pivotally mounted on the casing and a cocking member 7 pivotally mounted on the frame 1. Beneath the cocking member 7 a safety pin 21 is mounted on the frame. The safety pin can be moved to a position under the locking member 7 in order to hinder the latter's downward movement and secure the firearm. This prevents the firearm from going off, while removing the casing of the release mechanism from the firearm.

In the embodiment presented the release mechanism includes a trigger piece 25, a cocking arm 26 as well as adjusting springs and screws. The tip of the release step 6 rests upon the rocking arm 26. Thus the actual threshold for release is formed between between the release stem 6 and the rocking arm 26.

When the casing 3 of the release mechanism is in the firearm and the firearm is locked then the retaining threshold of the firing pin rests on the cocking member 7 the portruding tip 20 of which rests upon the release stem 6. As the trigger 5 is pulled backwards a screw 18 situated in the upper part of the trigger 25 pushes the rocking arm forward. This causes the elbow edge of the rocking arm 26 and release stem to approach each other. A screw 27 is adjusted so that it meets the surface of the rocking arm just before the elbow edge of the release stem 6 slides over the elbow edge of the rocking arm 26. Due to the leverages the required release force increases at the trigger and the user knows, when point of firing is near and a small further tightening causes the weapon to go off. The screws 128 and 27 can be adjusted through holes situated on the casing. A suitable counterforce is adjusted to the release stem 6 by a spring screw 22 so that the force caused by the locks striking spring which acts through the cocking member can be advantageously compensated for. With the aid of the spring screw 22 and by adjusting the spring 17 through a screw situated in the casing the needed release force can be adjusted. The resistance of the trigger can be adjusted by a spring 28.

The upper part 25 is connected to the trigger, and the rocking arm 26 is pivotally connected to the casing and cooperates with the upper part 25 and the release stem 6. The centers of gravity of said upper part 25 and release stem 6 have been arranged with respect to their pivots so that the cocked arm won't go off though its rear is hit on the ground.

The upper part 25 has been formed so that its centre of gravity is high with respect to its pivoting axis so that the upper part moves away from the rocking arm 26 if an impact is directed to the rear of the firearm 26. The rocking arm is formed so that in case an impact is directed to the rear of the fire-arm, the said arm is arranged to move towards the release stem 6. Thus the weapon won't go off. Moreover the trigger is manufactured of light material so that it won't effect unfavourably the weight ratios mentioned above.

The invention is not limited to the advantageous appliance described above as modifications can vary within the scope of the claims.

I claim:

1. In a firearm, a frame having a receiving housing, a trigger assembly including a casing detachably received within housing, releasable latching means for retaining the trigger assembly within said housing, said latching means having a latching position and a release position, locking means for the firearm and having a locked position and an unlocked position, and operating means interconnecting said locking means and said latching means and constructed and arranged to prevent release of said latching means when said locking means is in the locked position to thereby prevent said casing from being removed from said housing.

2. The firearm of claim 1 wherein said latching means comprises a latch pivotally connected to the casing and engageable with an abutment on the housing when in the latching position.

3. The firearm of claim 2 wherein said operating means includes a movable element disposed to be moved to an obstructing position by said locking means when said locking means is in the locked position, said movable element when in the obstructing position preventing said latch from being disengaged from said abutment.

4. The firearm of claim 3 wherein said movable element comprises a stud mounted for sliding movement in a hole in said frame.

5. The firearm of claim 1 and including cocking means, said cocking means comprising a first cocking member pivotally mounted on the frame and a second cocking member pivotally mounted on said casing and disposed to engage the first cocking member when the firearm is cocked.

6. The firearm of claim 5 and including a safety pin movable between a securing position and a release position, said safety pin when in the securing position disposed to engage said first cocking member to prevent movement of said first cocking member.

7. The firearm of claim 1 wherein said trigger assembly includes a trigger, an upper member connected to said trigger, a rocking arm pivotally connected to the casing and operably engageable with said upper member, the centers of gravity of said upper member and said rocking arm being arranged with respect to the pivot axis of said upper member and said rocking arm so that as the rear of the firearm is subjected to impact said upper member will move away from the rocking arm to prevent operation of said firearm.

* * * * *

UNITED STATES PATENT AND TRADEMARK OFFICE

CERTIFICATE OF CORRECTION

PATENT NO. : 4,662,098

DATED : May 5, 1987

INVENTOR(S) : JALI TIMARI

It is certified that error appears in the above-identified patent and that said Letters Patent is hereby corrected as shown below:

Col. 1, Line 59, After "only" insert --be-- Col. 2, Lines 4-5, Delete, "DESCRIPTION OF THE PREFERRED EMBODIMENT p" and substitute therefor the heading ---DESCRIPTION OF THE PREFERRED EMBODIMENT--

Col. 2, line 61, Delete "cocking" and substitute therefor ---rocking---; Col. 3, line 12, Cancel "128" and substitute therefor ---18---;

Col. 3, Line 45, After "within" insert ---the---.

Signed and Sealed this

Third Day of May, 1988

*Attest:*

*Attesting Officer*

DONALD J. QUIGG

*Commissioner of Patents and Trademarks*